United States Patent [19]

Achter et al.

[11] Patent Number: 4,739,221

[45] Date of Patent: Apr. 19, 1988

[54] A GAS DISCHARGE LAMP WITH A SINTERED CATHODE MEMBER FUSED TO A LEAD AND THE METHOD OF MANUFACTURE

[75] Inventors: Eugen Achter, Trebur; Michael Lausch, Taunusstein, both of Fed. Rep. of Germany

[73] Assignee: Siemens Aktiengesellschaft, Berlin and Munich, Fed. Rep. of Germany

[21] Appl. No.: 863,857

[22] Filed: May 16, 1986

[30] Foreign Application Priority Data

May 28, 1985 [DE] Fed. Rep. of Germany ..... 3519066

[51] Int. Cl.[4] ..... H01J 9/04; H01J 61/06

[52] U.S. Cl. ..... 313/632; 313/346 R; 445/50

[58] Field of Search ..... 313/631, 632, 346 R, 313/346 DC, 246; 445/26, 29, 49, 50

[56] References Cited

U.S. PATENT DOCUMENTS 4,099,084 7/1978 Hoene ..... 313/246 X
4,303,846 12/1981 Kimura et al. ..... 313/346 R

FOREIGN PATENT DOCUMENTS 505096 5/1939 United Kingdom .

*Primary Examiner*—David K. Moore
*Assistant Examiner*—K. Wieder
*Attorney, Agent, or Firm*—Hill, Van Santen, Steadman & Simpson

[57] ABSTRACT

The invention is directed to a gas discharge lamp particularly to a flash bulb and a method of making the flash bulb. The cathode member is formed by a sintered member whose outer shape is matched to the inside shape of the cavity of the housing in the cathode region and this sintered member is fused in the housing to form the connection with the lead of the cathode.

3 Claims, 1 Drawing Sheet

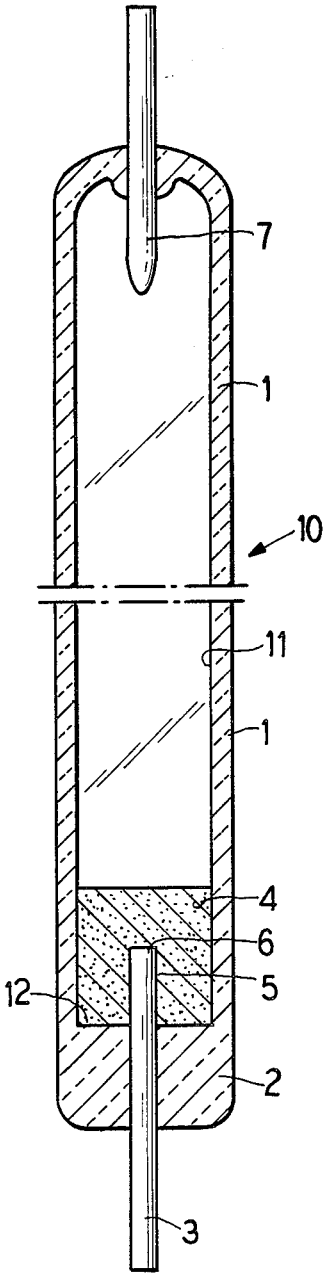
7
1
10
11
1
4
6
5
12
2
3

A GAS DISCHARGE LAMP WITH A SINTERED CATHODE MEMBER FUSED TO A LEAD AND THE METHOD OF MANUFACTURE

BACKGROUND OF THE INVENTION

The invention is directed to a gas discharge lamp which contains two electrodes in a gas-filled, light-transmissive housing, wherein the cathode is composed of a lead conducted through the housing in a vacuum-tight fashion and a cathode member electrically connected thereto.

It is know to fashion the cathode as a porous sintered member. This sintered member must be secured to the lead. The fastening or securing can occur by means of a mechanical deformation of the sintered member, by impressions, or by welding.

SUMMARY OF THE INVENTION

The present invention is directed to an object of providing a gas discharge lamp having a cathode composed of a lead conducted through the housing in a vacuum-tight fashion and a cathode member electrically connected thereto, wherein the electrical connection of the lead to the cathode member occurs without requiring a mechanical deformation of the sintered member and without impressing and/or welding.

To achieve these objects, the present invention is directed to an improvement in a gas discharge lamp which contains two electrodes in a gas-filled, light-transmissive housing wherein the cathode is composed of a lead conducted through the housing in a vacuum-tight fashion and a cathode member which is a sintered member and is electrically connected and to the lead. The improvement are that the outer shape of the cathode member is matched to the inside shape of the housing in the cathode region and that the cathode member is sintered while disposed in the housing. Due to the sintering of the member in the housing, it is fused to the lead and a separate mechanical fastening to the lead is no longer required.

BRIEF DESCRIPTION OF THE DRAWINGS

The FIGURE is a cross sectional view, with portions in elevation for purposes of illustration, of a gas discharge lamp in accordance with the present invention.

DESCRIPTION OF THE PREFERRED EMBODIMENTS

The principles of the present invention are particularly useful in a gas discharge lamp generally indicated at 10 in the FIGURE. The gas discharge lamp 10 comprises a glass housing 1 having an internal cavity 11 which is closed at its cathode side or end by a glass bottom 2 in which a lead 3 of tungsten is fused. The actual cathode is formed by a sintered member 4, whose outside shape is matched to the inside shape of the cavity 11 adjacent the cathode-side or end of the housing 1 which is adjacent the bottom 2. The sintered member 4 is fused in the housing 1. The housing 1 opposite the end 2 is provided with an anode 7 which is formed by a pin which is fused in the upper end of the housing 1 and lies opposite the sintered member 4. In the completed lamp, the cavity is filled with an appropriate gas and then sealed.

In manufacturing of the gas discharge lamp 10, the lead 3 was fused into the end 2 of the housing 1 with a portion of the lead extending beyond the surface 12 into the cavity 11 to form a projecting end 6. The sintered member, while still in a pressed green state is provided with a blind hole 5 so that it can be loosely plugged onto the end 6 of the lead 3. Subsequent to this assembly step, the green body is then fused or sintered while in a position to contact the bottom 2 of the housing 1 as illustrated. This fusing or sintering fuses the member 4 onto the end 6.

Instead of a blind hole 5, a through hole can be provided in the pressed, green member which is subsequently fused into the sintered member or body 4. It is also possible to entirely forgo a hole in the member when the inside end of the lead 3 terminates, for instance, flush with the inner wall surface 12 of the bottom 2 and when the member 4 can press against the lead 3 to form the connection.

The gas discharge lamp as described and the method of forming the gas discharge lamp has the following advantages:

1. Since a mechanical deformation does not occur, a requirement of ductility is eliminated for the composition of the sintered member 4.

2. No backspaces between the sintered member 4 and the surface 12 are present from which particles could proceed into the discharge space. In the illustrated example, the sintered member 4 is completely joined to the glass housing 1.

3. Since the sintered member is not impressed onto or welded to the lead 3, it is also not mechanically deformed, mechanical injury to the sintered member 4 is practically impossible. Therefore, particle fragments will not occur.

4. When electrically connecting this sintered member 4 to the lead 3, no activation material will emerge therefrom because there is no external forces applied while forming the connection.

5. Since heat dissipation is improved by the structure of the lamp, the atomization of the sintered member 4 is reduced.

It should be noted, that after sintering or fusing the member 4 in the cavity 11 of the housing 1, the housing is then completed by fusing the anode 7 into the housing 1 at the upper end as illustrated in the drawing and then the cavity is filled with the desired gas and then closed with a gas tight seal.

Although various minor modifications may be suggested by those versed in the art, it should be understood that we wish to embody within the scope of the patent granted hereon, all such modifications as reasonably and properly come within the scope of our contribution to the art.

We claim:

1. In a gas discharge lamp which contains two electrodes in a gas-filled, light-transmissive housing with a cathode being composed of a lead conducted through an end wall of the housing in a vacuum-tight fashion and being electrically connected to a cathode member, the improvements comprising the housing adjacent said lead having a cavity with an inner surface including a surface of the end wall, an outer shape of the cathode member being matched to an inside shape of the cavity of the housing in the region of the cathode and the cathode member being a sintered member fused in said housing to be joined to the lead and to engage the inner surface of the cavity and end wall adjacent the lead.

2. A method of forming a gas discharge lamp which contains two electrodes in a gas-filled, light-transmissive housing, said method comprising steps of providing a housing having a cavity with a lead extending through one end wall of the housing into the cavity, positioning a pressed unsintered member in the housing and in contact with the end wall and an end of the lead extending through the end wall of the housing, elevating the temperature of the housing and member to fuse the member to form a sintered member which is fused to the lead to form an electrical connection and which contacts the end wall and adjacent surfaces of the cavity, subsequently providing an anode spaced from said sintered member, filling the housing with a gas and then sealing the housing in a gas-tight manner.

3. A method according to claim 2, wherein the step providing the housing and having a lead extending through one end wall provides a housing having a lead extending through the one end wall and into a cavity of the housing, and said step of providing an unsintered member provides a member having an aperture for loosely receiving a portion of the lead extending into the cavity.

* * * * *